United States Patent [19]

Friedman

[11] Patent Number: 4,649,396

[45] Date of Patent: Mar. 10, 1987

[54] DOUBLE-TUNED BLADE MONOPOLE

[75] Inventor: Clifford H. Friedman, E. Northport, N.Y.

[73] Assignee: Hazeltine Corporation, Commack, N.Y.

[21] Appl. No.: 769,119

[22] Filed: Aug. 26, 1985

[51] Int. Cl.[4] ..... H01Q 1/28; H01Q 9/38

[52] U.S. Cl. ..... 343/705; 343/829

[58] Field of Search ..... 343/705, 708, 828, 829, 343/830, 831, 846, 899

[56] References Cited

U.S. PATENT DOCUMENTS 3,039,095 6/1962 Josephson ..... 343/830

*Primary Examiner*—Eli Lieberman

*Attorney, Agent, or Firm*—E. A. Onders; F. R. Agovino

[57] ABSTRACT

A monopole antenna is mounted on a ground plane and incorporates a radiating structure in the form of a blade perpendicular to the ground plane, for loading the antenna. An elevated feed is formed by a biconical central post between the blade and the ground plane. Tuning is also accomplished by a capacitive strips spanning the biconical central post and by outboard inductive posts which connect between the ground plane and the blade to provide shunt inductance. Alternatively, additional tuning may be accomplished by a circuit between upper and lower portions of the central post.

12 Claims, 4 Drawing Figures

DOUBLE-TUNED BLADE MONOPOLE

BACKGROUND OF THE INVENTION

This invention relates to a monopole antenna and, more particularly, to a blade monopole antenna which is mounted on a ground plane and is smaller than a wavelength of operation.

A monopole antenna having dimensions smaller than a wavelength of operation is useful in situations requiring an omnidirectional radiation pattern, and fairly close impedance matching to a line over a large bandwidth. In a common form of construction, such an antenna is mounted on a ground plane which serves as an element of the antenna in establishing the radiation pattern. Particular utility of such a construction is found in situations wherein the antenna is mounted on an exterior electrically conductive surface of a vehicle such as an aircraft, for transmission and reception of electromagnetic signals, and wherein the exterior surface of the aircraft serves as the ground plane.

It is desirable, in the case of vehicular communication, to minimize the size of the antenna, to provide a uniform antenna radiation pattern, and to operate over a large bandwidth with minimum standing wave ratio (VSWR).

In general, such antennas are described in Harold A. Wheeler's article entitled "Small Antennas", IEEE Transactions on Antennas And Propagation Vol AP-23, No. 4, pages 462–469, July, 1975. See also U.S. patent application Ser. No. 06/741,333 filed June 5, 1985 for Double Tuned Disc Loaded Monopole incorporated herein by reference.

SUMMARY OF THE INVENTION

The foregoing desirable features and other advantages are provided by a monopole antenna mounted on a ground plane. The invention simplifies the overall configuration of the antenna as well as components of the antenna structure which tune the antenna to a prescribed frequency band. In accordance with the invention, loading of the antenna is provided by a blade spaced apart from the ground plane and perpendicular thereto separated by a central post which extends between the blade and the ground plane. The post is formed with an upper portion connected to the blade and a lower portion connected to the ground plane. The upper and lower portions have opposing conical faces. The lower portion is in contact with the ground plane and has left and right sections forming a gap within which a transmission line is located and is connected to the upper portion. Tuning of the antennas is accomplished by either of two structures. The first tuning structure comprises a capacitive strip separated from and spanning the upper and lower portions of the central post and a set of inductive strips spaced apart from the central post and connecting the blade with the ground plane. The second tuning structure comprises a printed circuit, or circuit elements formed of a conductive strip mounted on the dielectric slab located between the conical faces of the upper and lower portions.

BRIEF DESCRIPTION OF THE DRAWING

The foregoing aspects and other features of the invention are explained in the following description, taken in connection with the accompanying drawing wherein.

DETAILED DESCRIPTION

Figure 1:
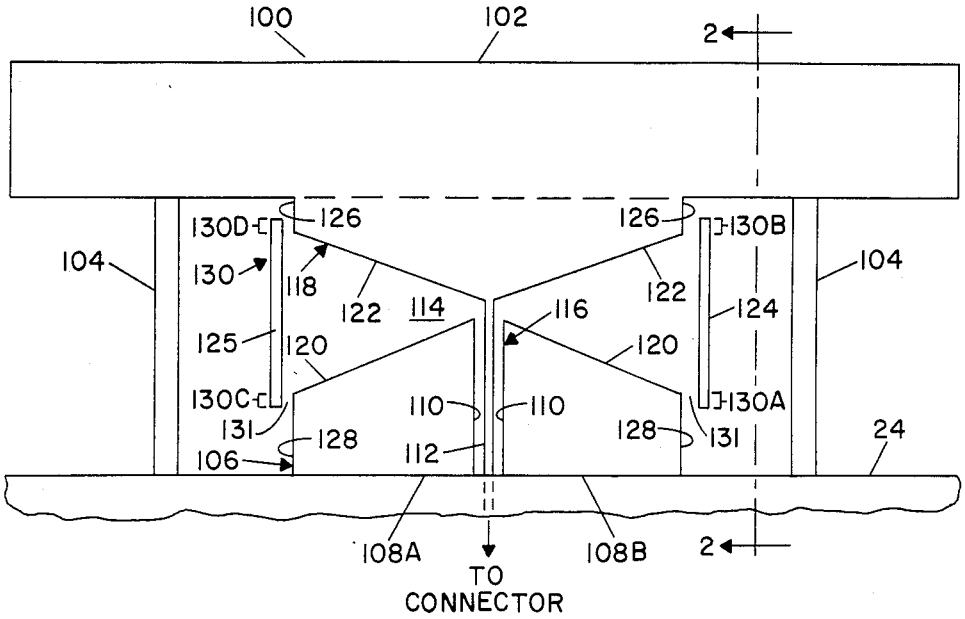
FIG. 1 is a plan view of one embodiment of a monopole antenna of the invention wherein loading is accomplished by a blade, and tuning is accomplished by outboard inductive posts and a capacitive strip overlay.
Figure 2:
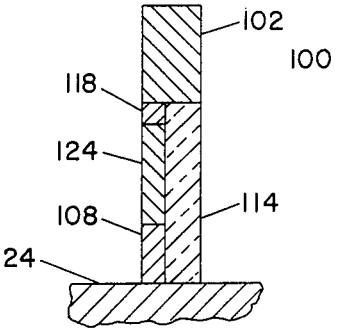
FIG. 2 is a sectional view along line 2—2 of FIG. 1.

FIGS. 1 and 2 show a first embodiment of the invention wherein a monopole antenna 100 is constructed with a blade 102 of electrically conducting material, such as aluminum or copper, and is mounted perpendicular to and spaced apart from an electrically conducting member 24 which serves as a ground plane. Typically, the size of the member 24 is larger than that of the blade 102 and, in the case of the mounting of the antenna 100 on the outer surface of a vehicle such as an aircraft (not shown), the member 24 is formed by the outer surface of the vehicle. The member 24 supports a dielectric slab 114 on which 106 and an upper portion 118 are mounted.

The elevated feed 106 comprises a pair of symmetrically positioned vanes 108 having parallel edges 110 which are spaced apart a sufficient distance for emplacement of a strip conductor 112 along a central axis of the antenna 100, and insulated from the vanes 108. A dielectric slab 114 serves as a substrate or support against which the vanes 108 and the strip conductor 112 are positioned to form a microstrip transmission line 116. The edges 110 are spaced apart from the strip conductor 112 with a spacing selected to provide a desired impedance to the transmission line 116.

The antenna 100 further comprises a central truncated post having an upper portion 118 which is in electrical contact with the blade 102 and extends therefrom towards an upper terminus of the lower portion 106. Each section **108*a*, 108*b* of lower portion 106 is provided with an inclined edge 120, the two edges 120 providing the form of a triangular edge to the upper terminus of the lower portion 106. The triangular shape of the upper terminus of the lower portion 106 forms the lower portion of the biconical feed. The upper portion 118 is provided with a pair of inclined edges 122 which face the corresponding edges 120 of the lower portion 106. The configuration of the inclined edges 122 of the upper portion 118 forms the upper portion of the biconical feed. The central strip conductor 112 of the transmission line 116 is located within the gap 110 formed by sections 108*a*, 108*b* and extends upward to make electrical contact with the upper portion 118. The sections 108*a* and 108*b*, the posts 104, the upper portion 118, and the blade 102**, are all fabricated of an electrically conducting material such as copper.

Figure 4:
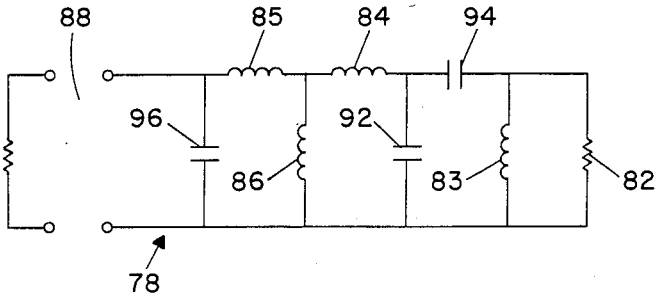
FIG. 4 shows a typical equivalent circuit of the antenna of the invention.

With respect to the construction of a capacitive structure, a pair of metallic strip conductors 124, shown in FIGS. 1 and 2, are supported by the slab 114. Conductors 124 are spaced apart from the upper portion 118 and the lower portion 106. Upper and lower ends of the strips 124 overlap (or span), respectively, edges 126 of the upper portion 118 and edges 128 of sections **108*a* and 108*b* to serve as plates of capacitors. Thus, on the right side of the lower portion 106 and the upper portion 118 are formed capacitors 130A and 130B, while capacitors 130C and 130D are formed to the left. The capacitors 130A–B are connected in series with each other via the right strip conductor 124 while the capacitors 130C–D are connected in series with each other via the left strip conductor 124. The combination of capacitors 130A–B and 130C–D are arranged in parallel to provide a resultant capacitor 130 between the blade 102 and the ground plane member 24. The capacitance of the capacitor 130 and inductance provided by the posts 104 are arranged in shunt configuration with respect to currents coupled via the upper portion 106 between the member 24 and the blade 102. The equivalent circuit is shown in FIG. 4** and discussed below.

Figure 3:
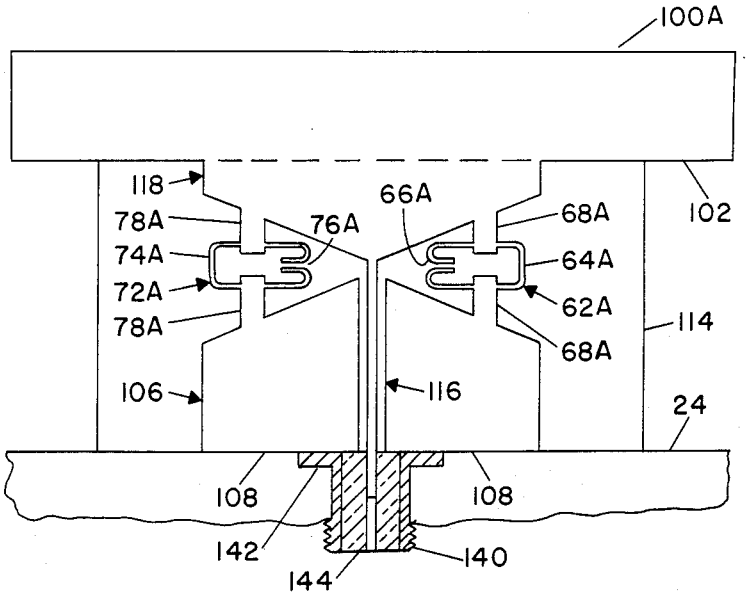
FIG. 3 is a plan view of a modification of the embodiment of FIG. 1 with tuning accomplished by a printed circuit.

FIG. 3 shows an antenna 100A which is a modification of the antenna 100 of FIGS. 1 and 2. The structure of the capacitor 130 and the inductive posts 104 (FIGS. 1 and 2) is replaced, in FIGS. 3, with printed circuits 62A, 72A comprising inductive components in the form of a pair of wire or strip segments 64A, 74A mounted on the dielectric slab 114 and electrically connected via strips 68A, 78A between the upper portion 106 and the lower portion 118. The construction of the segments 64A, 74A also includes capacitive components. Thus, each printed circuit 62A, 72A provides a capacitor 66A, 76A. The capacitors 66A, 76A and the inductors 64A, 74A are arranged in shunt configuration with respect to electric currents coupled via the lower portion 106 between the member 24 and the blade 102. The discussion below of FIG. 4 applies also to the antenna 100A of FIG. 3.

The bandwidth and standing wave ratio attainable with the antennas 100 and 100A of FIGS. 1–3 are comparable to those attainable with the antennas of Ser. No. 06/741,333. The two embodiments of the antenna, namely, the circular embodiment of Ser. No. 06/741,333 and the fin-shaped embodiment of FIGS. 1–3 may be used interchangeably except that the fin-shaped embodiment is preferred in the case of an antenna mounted on the exterior surface of an aircraft. The fin-shaped antenna permits air to flow past the aircraft without the introduction of any more than a minimal amount of turbulance.

By the way of further modification in the construction of the antennas 100 and 100A of FIGS. 1–3, it is noted that the tuning elements, namely the posts 104, the strip conductors 124, and the wire segments 64A may be embedded within a dielectric slab as shown in FIG. 2, rather than being printed or mounted on a surface thereof. If desired, front and back dielectric slabs (not shown) may be provided for fully enclosing the lower portion 106 and the upper portion 118. In all of the foregoing embodiments of the invention, the amount of inductance provided by the post 104 is selected in a conventional well known manner by constructing the posts with the appropriate cross sectional dimensions. In addition, the inductance presented by the truncated posts 46 and 118 is also dependent on their respective cross sectional dimension. The spacing between the edges 120, 122 and the corresponding outer inductive post 104 may also be adjusted to attain a desired amount of overall inductance and transformation ratio associated with the biconical transmission line configuration.

Transmission line 116 is disposed along a central axis between sections **108*a* and 108*b* within gap 110 and comprises a central conductor 112 surrounded by an insulating central bore 110. Sections 108*a* and 108*b* serve as the outer conductor of the transmission line 116. The transmission line 116 terminates at its lower end in a connector 140 (shown in FIG. 3 only) having a flange 142 which abuts the member 24, and a thread 144 by which engagement is made with a connector of a coaxial cable (not shown) for conduction of electromagnetic signals between the antenna 100, 100A** and a source and/or receiver (not shown).

An upper portion 118 is connected to the central portion of the blade 102 and is constructed of an electrically conducting material such as copper. The upper portion 118 extends over only a part of the distance between blade 102 and the ground plane member 24, the lower terminus of the upper portion 118 contacting the upper end of the central conductor 112 of the transmission line 116. The upper portion 118 has an outer edge 126 in the upper part of the upper portion 118, and terminates in a cone 122 at the lower end of the upper portion 46. The cones 120 and 122 provide the configuration of a biconical transmission line for coupling from the upper portion capacitor sections 130B, 130D to the lower portion capacitor sections 130A, 130C with the area 131 serving as the dielectrical layer between the edges 126, 128 and the strips 124, 125. The central portion of the strip 124 serves as a electrical conductor for series interconnection of the capacitor sections 130A and 130B, and the central portion of strip 125 of the capacitor sections 130C and 130D.

With respect to tuning of the antenna 100, the elevated structure of the lower portion 106 may be treated as a projection of the ground plane established by the member 24. The upper portion 118 serves as a series inductor to currents flowing between the lower portion 106 and the blade 102. The capacitors 130 provides a shunt path for current flow between the blade 102 and the member 24. From the outer end of the biconical arrangement of the surfaces of the cones 120 and 122, the series inductance of the central post 106, and the shunt inductances of the outer posts 104 act as a transformer to the antenna impedance as presented to the biconical line. Thereby, the impedance presented by the combination of the foregoing capacitance and inductance in combination with the radiation resistance is modified by the impedance transformation ratio associated with the foregoing transformer. This enables the wideband matching of the antenna 100.

The printed circuit 62A of FIG. 3 may be formed by conventional photolithographic technology wherein strip conductors are laminated to a substrate or, alternatively, may be fabricated of a set of wire segments. Each segment 64A is bent to form parallel branches. Each strip 68A, 78A provides an electrical connection between the corresponding upper portion 118 and the corresponding lower portion 106.

With reference to the circuits 62A, 72A fully shown within FIG. 3, the portions 64A, 74A define inductors 64A, 72A. The segments 66A, 76A terminate in two parallel end portions which define capacitors. The inductor and the capacitor are connected in parallel between the surfaces 120 and 122. The central post 106, 118 introduces a series inductance.

The antenna according to the invention achieves a bandwidth which is greater than that achievable by a simple monopole of the same overall dimensions in wavelength. The results are illustrated in FIG. 4 of Ser. No. 06/741,333 as a plot of VSWR vs. frequency, incorporated herein by reference. These charts have been prepared in accordance with H. A. Wheeler's September, 1984 article titled "Reflection Charts Relating To Impedance Matching", IEEE Transactions Vol. MT- 32, pp. 1008–1021. Note that the impedance plot forms two turns around the chart, which may be interpreted as implying that the disc-loaded monopole is double tuned and as suggesting that even greater bandwidth may be achieved by triple tuning.

FIG. 4 shows a conceptual equivalent circuit applicable in general terms to FIGS. 1 and 3. It represents the tuning of the antenna for wideband matching, which is one objective of the invention. A resistor 80 at the line terminals 88 of the antenna circuit 78 represents the impedance of the associated transmitter or receiver circuit as seen through a line of indeterminate length. A resistor 82 at the opposite end represents the radiation of power from the antenna. From the circuit viewpoint, capacitors 92 and 94 represent the shunt and series capacitance associated with the space under the blade 102 and just outside, while the inductor 83 represents the magnetic energy associated with the transition to radiation. The total capacitance 92, 94 is tuned by the inductor 84, 86 to a frequency near midband. For double tuning, the inductor 85 is tuned with capacitor 96, likewise at a frequency near midband. The inductor 85 provides the coupling required for double tuning. The composite inductor 84, 85, 86 is proportioned to provide also an impedance transformation between the two resistors, 80, 82 as required for impedance matching.

The elements in the equivalent circuit can be identified with the structural features in FIG. 1. Series capacitor 94 represents the external capacitance between the blade 102 and the radiation space represented by inductor 83 and resistor 82. Shunt capacitor 92 represents the capacitance in the space under the blade 102. The composite inductor 84, 85, 86 represents, in general terms, the shunt inductance of the posts 104 and the series inductance in the space around the center post 106, 118. It is well known that a composite inductor such as 84, 85, 86 can provide shunt and series inductance and an impedance transformer ratio. The shunt capacitor 96 represents the shunt capacitance provided by the strips 124, 125 and the dielectric space 131 directly across the terminals of the conical line extension 120, 122. The identification of the equivalent circuit with the structural features can be achieved by computing or measuring the frequency dependence of impedance 88.

A similar correlation between FIG. 3 and a modification of FIG. 4 could be described but the concepts would remain the same. In particular, it is noted that, in view of the transformer effect produced by the biconical structure of the cones, the effective inductance and capacitance is enhanced to permit tuning of the antennas 100 and 100A over a broad frequency band while maintaining increased effective height between the ground plane member 24 and the blade 102, as well as maintaining a relatively low value of standing wave ratio.

By way of example in design of the antennas 100 and 100A, a bandwidth of 3:1 and SWR of 3:1, or a bandwidth of 2:1 and SWR of 2:1 represent approximate values of attainable performance characteristics. For example, a bandwidth may range from 300–600 MHz (mergahertz), or 300–900 MHz, or 600–1200 MHz. By way of example, a model of the antenna 100 (FIGS. 1 and 2) transmitting over a bandwidth of 300–900 MHz has a height of three inches and a width of seven inches.

By virtue of the foregoing description, there is provided a monopole antenna which is convenient to manufacture, and which includes readily fabricated tuning elements for selection of an operating frequency band. In addition, a biconical configuration of feed and central post provides the effect of a transformer which transforms both load and tuning impedance for increased frequency bandwidth and reduced standing wave ratio, while maintaining an enlarged effective height of the antenna for more efficient transmission and reception of radiant energy.

It is to be understood that the above described embodiments of the invention are illustrative only, and that modifications thereof may occur to those skilled in the art. Accordingly, this invention is not to be regarded as limited to the embodiments disclosed herein, but is to limited only as defined by the appended claims.

What is claimed is:

1. A blade monopole antenna comprising:

a dielectric slab;

ground means for establishing a ground plane;

a blade of conductive material mounted on a dielectric slab and spaced apart from said ground means and perpendicular thereto;

tuning means disposed between said blade and said ground means for tuning said antenna, said tuning means including a central conductive post with an upper portion connected to the blade and a lower portion coaxial with the upper portion and connected to the ground means, said lower portion having left and right sections forming a gap therebetween, said portions defining a radially tapered opening therebetween;

a transmission line mounted on the slab within the gap between the left and right sections of said lower portion in contact with said upper portion; and means for supporting said slab perpendicular to said ground means.

2. An antenna according to claim 1 wherein said ground means is a flat plate of conducting material.

3. An antenna according to claim 1 wherein the upper and lower portions have a tapered opening therebetween in the form of a biconical transition.

4. An antenna according to claim 1 wherein said tuning means are conductive posts mounted on said slab adjacent to and spanning the upper and lower portions to provide shunt capacitance and further including a pair of solid, inductive posts spaced apart and outward from said conductive posts and electrically connecting said blade with said ground plane.

5. An antenna according to claim 1 wherein said tuning means further comprises a printed circuit mounted on said dielectric slab interconnecting said upper and lower portions.

6. An antenna according to claim 5 wherein said printed circuit is located within a tapered opening between said portions.

7. An antenna according to claim 6 wherein said printed circuit comprises a strip electrical conductor having parallel branches connected at one end by a bent-wire inductor.

8. An antenna according to claim 6 wherein said printed circuit means comprises a strip electrical conductor having parallel branches connected at one end by a bent-wire capacitor.

9. An antenna according to claim 8 wherein said parallel branches are connected at the other end in a bent-wire inductor.

10. An antenna according to claim 9 wherein said bent-wire inductor provides an inductance and said bent-wire capacitor provide a capacitance in parallel with said inductance.

11. An antenna according to claim 9 wherein said bent-wire inductor provides shunt inductance between said blade and said ground plane, and wherein said bent-wire capacitor provides shunt capacitance between said blade and said ground plane.

12. An antenna according to claim 1 wherein said central post has a width which is at least one-tenth of the height of said central post.

* * * * *